US005760389A

United States Patent [19]

Biasi

[11] Patent Number: 5,760,389

[45] Date of Patent: Jun. 2, 1998

[54] OPTOELECTRONIC DEVICE FOR MEASURING THE GROUND CONTACT TIME AND POSITION OF A HOLLOW BODY WITHIN A PRESET REGION

[75] Inventor: Roberto Biasi, Bolzano, Italy

[73] Assignee: Microgate S.r.l., Bolzano, Italy

[21] Appl. No.: 666,700

[22] Filed: Jun. 18, 1996

[51] Int. Cl.[6] ..... G01V 9/02; G08B 13/18

[52] U.S. Cl. ..... 250/221; 250/222.1; 250/214 L; 340/555

[58] Field of Search ..... 250/221, 222.1, 250/214 L; 340/555–557

[56] References Cited

U.S. PATENT DOCUMENTS

| | | | |
|---|---|---|---|
| 3,764,813 | 10/1973 | Clement et al. | 250/221 |
| 3,805,061 | 4/1974 | De Missimy et al. | 250/221 |
| 4,216,956 | 8/1980 | Yamamura . | |
| 5,081,896 | 1/1992 | Hiyoshi et al. | 250/221 |
| 5,125,647 | 6/1992 | Smith . | |
| 5,198,661 | 3/1993 | Anderson et al. | 250/222.1 |
| 5,414,256 | 5/1995 | Gurner et al. | 250/221 |

FOREIGN PATENT DOCUMENTS

| | | |
|---|---|---|
| 30 29 646 | 3/1982 | Germany . |
| 40 30 507 | 4/1992 | Germany . |

*Primary Examiner*—Stephone Allen
*Attorney, Agent, or Firm*—Guido Modiano; Albert Josif

[57] ABSTRACT

An optoelectronic device for measuring the ground contact time and position of a body within a preset region, having a first measurement bar, which includes one or more infrared light beam transmitters, and a second measurement bar, which is arranged opposite and parallel to the first bar and includes one or more receivers, the number whereof is equal to the number of transmitters present in the first bar. The first and second bars are connected one another by means of an electrical line and form a measurement area therebetween.

12 Claims, 1 Drawing Sheet

OPTOELECTRONIC DEVICE FOR MEASURING THE GROUND CONTACT TIME AND POSITION OF A HOLLOW BODY WITHIN A PRESET REGION

BACKGROUND OF THE INVENTION

The present invention relates to an optoelectronic device for measuring the ground contact time and position of a body within a preset region, particularly adapted for performing tests for determining the degree of athletic fitness of an individual.

In the sports field, one of the most widely used tests for evaluating the degree of athletic preparation of individuals who must undergo physical training consists in measuring the contact and flight time during hops in place according to prescribed methods. The height reached by the center of gravity of the individual being examined is calculated by measuring the duration of the hop.

This information, together with the rate of the hops made, allows to evaluate the average developed energy and other biomechanical parameters.

This test is very simple to perform, does not require expensive equipment, and offers a high degree of repeatability, to the point that its results have become a universally acknowledged examination criterion in many sports.

Devices constituted by a unit for processing and displaying the data, generally consisting of an electronic notebook provided with a dedicated program or of a simple chronometer, and by a platform measuring approximately 70×100 cm, are currently available for performing this test.

The platform includes a matrix of electromechanical contacts that are spaced from one another by approximately 5–10 cm.

The person subjected to the test must therefore perform the hops on the platform in order to measure the values of the test.

However, this device has several drawbacks and shortcomings essentially due to the use of the platform.

One drawback resides in the fact that the precision and repeatability of the acquired times is not satisfactory, due to the discrete distribution of the contact points and due to the damping introduced by the rubber-like matrix in which said contact points are embedded.

Another drawback arises from the dynamic response characteristics of the platform, which are different from those of the surfaces present on the playing field.

Furthermore, general reliability is not high due to the presence of electromechanical contacts that are intensely stressed at each hop performed by the person being examined.

Finally, it is not easy to transport the platform, owing to its size.

SUMMARY OF THE INVENTION

A principal aim of the present invention is therefore to provide an optoelectronic device for measuring the ground contact time and position of a body within a preset region, which is capable of overcoming the above-mentioned drawbacks and allows to achieve high precision and repeatability in the measurement of the parameters related to the test.

Within the scope of this aim, an object of the present invention is to provide an optoelectronic device that can be used on any surface and with any type of shoe.

Another object of the present invention is to provide an optoelectronic device that is reliable in operation.

Another object of the present invention is to provide an optoelectronic device that is versatile and expandable for different uses.

Another object of the invention is to provide an optoelectronic device that is compact and thus easy to transport.

Another object of the present invention is to provide an optoelectronic device that is relatively easy to manufacture and at competitive costs.

This aim, these objects, and others which will become apparent hereinafter are achieved by an optoelectronic device for measuring the ground contact time and position of a body within a preset region, characterized in that it comprises a first measurement bar, which includes one or more infrared light beam transmitters, and a second measurement bar, which is arranged opposite and parallel to said first bar and includes one or more receivers adapted to receive said light beams, said first and second measurement bars, connected to each other by an electrical line, forming a measurement area therebetween.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 2:
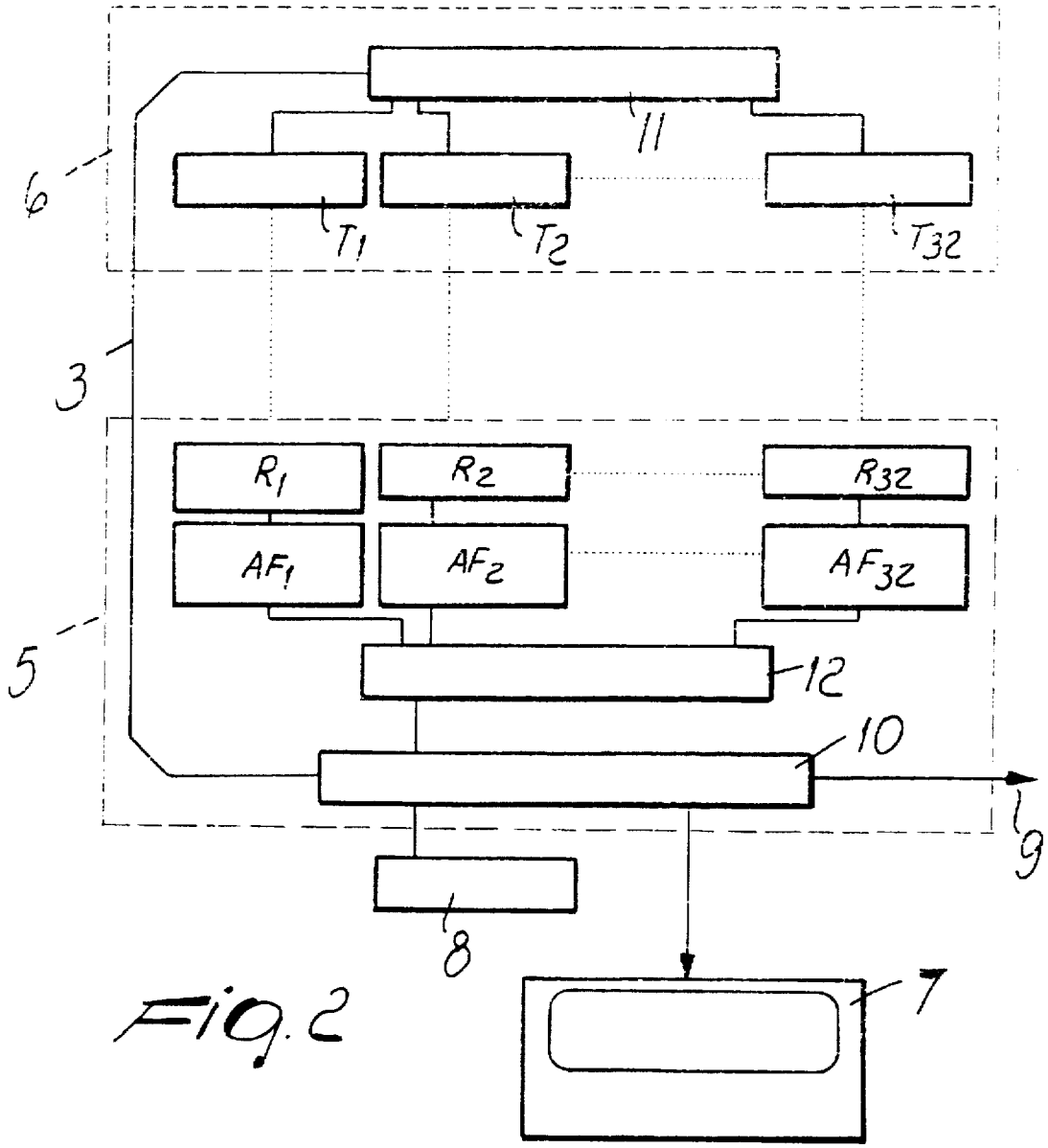
FIG. 2 is a block diagram of the data acquisition device of the optoelectronic device according to the invention.
Figure 1:
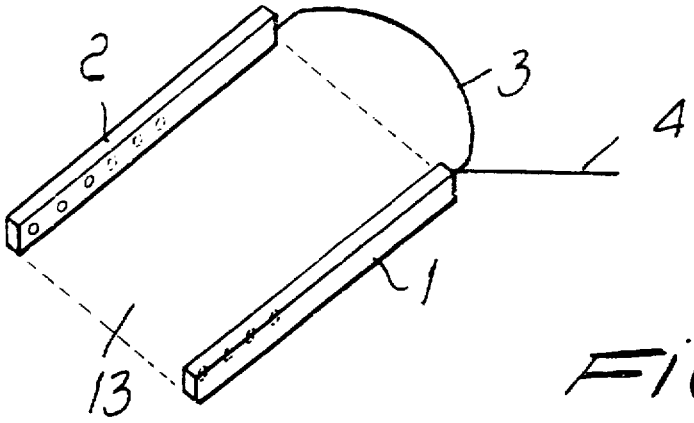
FIG. 1 is a perspective view of a preferred embodiment of the device according to the invention.

With reference to the above figures, the optoelectronic device according to the invention comprises two measurement bars 1 and 2, the approximate dimensions whereof are, advantageously but not exclusively, 1000×25×25 mm; said bars are arranged so as to be parallel and face each other on any surface and internally form a measurement area 13.

The two bars 1 and 2, which are spaced from one another by approximately no more than 3 meters, are connected to each other by an appropriate electrical connection 3.

A connecting line 4 branches off from said electrical connection 3 to connect to a chronometer or other time measurement device (not shown).

The data acquisition device is divided into two sections: a receiver section 5 and a transmitter section 6, which are respectively included in the measurement bars 1 and 2 and are connected one another by the electrical connection 3.

The receiver section 5 is furthermore connected to power supply means 8 and to means 7 for measuring, processing, and displaying the data, which are advantageously constituted by a computer provided with program-based means or by a simple programmable chronometer.

The power supply means 8 are advantageously constituted by an appropriate power supply or by accumulators adapted to supply power to the data acquisition device.

The transmitter section 6 internally comprises a shift register 11 adapted to activate a certain number (32) of transmitter means $T_1, T_2, \ldots, T_{32}$ advantageously constituted by infrared light beam transmitters which are included in the measurement bar 1 and arranged as close as possible to the resting surface of said bar.

The receiver section 5 instead internally comprises logic control and storage means 10, which comprise a time reference for driving the shift register 11 (by means of the electrical connection 3) and multiplexing means 12, and are adapted to store the signal originating from amplifier and filter means $AF_1, AF_2, \ldots, AF_{32}$. The multiplexing means 12 are conveniently constituted by a multiplexer.

Amplifier and filter means $AF_1, AF_2, \ldots, AF_{32}$ are connected to the multiplexer 12 and are equal in number to receiver means $R_1, R_2, \ldots, R_{32}$ that are connected thereto and in turn numerically match the transmitter means $T_1$–$T_{32}$. The receiver means $R_1$–$R_{32}$, conveniently constituted by infrared light beam receivers, are also arranged in the measurement bar 2 as close as possible to the resting surface of said bar and at the same height as the transmitter means $T_1$–$T_{32}$.

Connection to successive transmitter/receiver modules is provided by means of an electrical line 9 that leaves the logic control and storage means 10.

With reference to the above figures, operation of the optoelectronic device according to the invention is as follows.

The person being examined stands within the area 13 that is delimited by the measurement bars 1 and 2 to perform the test and performs upward hops.

The device is activated by closing an external electronic switch (not shown) that is connected to the electrical line 4.

The logic control and storage means 10 drive, by means of an internal time reference, the shift register 11 (in the transmitter section) and the multiplexer 12 (in the receiver section). In this manner, the individual pairs of transmitters T and receivers R arranged in front of each other are activated synchronously and sequentially, and the transmitters transmit infrared light beams in sequence.

It is important to stress that it is necessary to sequentially activate each transmitter/receiver pair if one wishes to use incoherent light beams. Due to the incoherent nature of the light, an individual transmitter T might normally activate more than one receiver R, so that the light beam is received along an axis that does not lie at right angles to the measurement bars 1 and 2, thus altering the measurements that are made. The sequential activation of the individual pairs allows therefore to perform a quick scan of the region 13 inside which the test is conducted, without running the risk of activating a receiver R that is not exactly the one lying opposite the transmitter T that is emitting the light beam at that exact moment.

The presence of a body inside the area designated by 13 causes the beams emitted by the transmitters $T_1$–$T_{32}$ to be interrupted due to the interposition of the body and therefore to fail to reach the corresponding receivers $R_1$–$R_{32}$. The interruption of the light beams is detected with high time accuracy, on the order of approximately 0.5 milliseconds.

The activation time of each transmitter/receiver pair is approximately 15 microseconds, which is equal to the ratio between the sampling time (0.5 milliseconds) and the number of transmitter/receiver pairs that are present (32 in the case being considered).

With this device it is furthermore possible to acquire the position, in relation to the measurement bars 1 and 2, where the athlete or body being examined touched the ground.

The spatial resolution of the device, by virtue of the sequential scanning of the light beams, is equal to the distance between two contiguous light beams (approximately 30 mm in one embodiment); therefore, this is also the minimum size of a body that can be detected by the device within the measurement area 13.

Both the transmitters $T_1$–$T_{32}$ and the receivers $R_1$–$R_{32}$ are arranged as close as possible to the resting surface, so as to limit the error in evaluating the moment of contact with the surface of the body being tested when the body approaches the ground with a finite speed.

The output signal from the device on the electrical line 4 is of the logic type. One state of the signal corresponds to the interruption of the optical barrier and thus to the moment of contact of a body on the surface within the measurement area 13, whereas the second state indicates the correct reception of all the light beams that have been transmitted. In this case, the instant in time corresponds to the flight time.

Said output signal, by means of the line 4, reaches the data measurement, processing, and display means 7. Said means, by means of an appropriate program, acquire the times and calculate the height of the center of gravity of the athlete at the peak of his hop and estimate other biomechanical parameters, such as the average energy produced during the test, etcetera.

In particular, if the means 7 are constituted by an appropriately programmed computer, it is possible to have, in real time, a graphical and numeric visualization of the hops performed by the athlete. The interfacing of the computer to the optoelectronic device requires no modification or addition of hardware to said computer.

In practice it has been observed that the device according to the invention fully achieves the intended aim and objects, since it allows to achieve high measurement precision and repeatability for the parameters related to the test conducted by the person being examined.

The possibility of using incoherent light beams with high reliability allows to reduce costs for the device with respect to a case requiring the use of beams of coherent light, such as laser light.

Furthermore, the device according to the invention, which in practice replaces the electromechanical platform of the prior art, is reliable, compact, and thus easy to transport as well as versatile and expandable.

The device thus conceived is susceptible of numerous modifications and variations, all of which are within the scope of the inventive concept; all the details may furthermore be replaced with other technically equivalent elements.

The device is in fact constructed according to a modularity criterion, so that it is possible to arrange a plurality of modules side by side so as to extend at will the measurement area along the measurement axis.

This extension allows, for example, to acquire the contact and flight times of an athlete who runs within said measurement region, in addition to allowing to determine the length of the strides while running.

The use of two devices arranged at right angles to each other allows to also obtain the position on the plane where contact between the body and the resting surface occurs, in addition to the normal position along the measurement bar of the individual device. A three-dimensional point of contact of the body with respect to the ground is thus obtained.

If instead two devices arranged side by side so as to be parallel are used, it is possible to perform independent measurements for the right leg and for the left leg while running in place; in this manner, it is possible to evaluate any asymmetries.

The device can also be used in other fields apart from sports. For example, its accuracy and spatial resolution allow to use two vertically arranged devices to measure the speed of a body that follows an unknown path.

Another possible application could be the replacement of the electromechanical contacts normally used in elevators to switch on the internal light.

In practice, the materials employed, so long as they are compatible with the specific use, as well as the shapes and the dimensions, may be any according to the requirements and the state of the art, without thereby abandoning the scope of the protection of the appended claims.

What is claimed is:

1. An optoelectronic device for measuring the ground contact time and position of a body within a preset region, comprising a first measurement bar, which includes one or more infrared light beam transmitters, and a second measurement bar, which is arranged opposite and parallel to said first bar and includes one or more receivers that are adapted to receive said light beams, said first and second measurement bars, connected to each other by means of an electrical line, forming a measurement area therebetween, logic control and storage means being provided to synchronously and sequentially activate opposite pairs of said transmitters and said receivers and to output a logic signal that indicates the interruption of beams or the complete reception thereof on the part of said one or more receivers, wherein said one or more transmitters and said one or more receivers are arranged close to the ground, said logic signal giving an indication of the moment of contact of the body on the surface defined between the measurement bars and of the moment of non contact of the body on said surface, data measurement, processing and display means being provided to receive said signal, calculate the height of the center of gravity of the body and estimate biomechanical parameters.

2. A device according to claim 1, wherein said logic control and storage means are arranged inside said bars.

3. A device according to claim 1, wherein said shift register is connected to said one or more transmitters.

4. A device according to claim 1, wherein said data measurement, processing, and display means comprise a computer provided with program-based means.

5. A device according to claim 1, wherein said data measurement, processing, and display means comprise a programmable chronometer.

6. A device according to claim 1, wherein one or more pairs of measurement bars are connected in series so as to extend the measurement area.

7. A device according to claim 1, wherein two pairs of measurement bars are arranged side by side and are adapted to perform independent measurements for the left leg and for the right leg of a human being located within said measurement area.

8. A device according to claim 1, wherein two pairs of measurement bars are arranged transversely to one another so as to allow to detect the position, within the measurement area, of a body that moves within said measurement area.

9. A device according to claim 1, wherein said logic control and programming means are adapted to drive a shift register that is arranged inside said measurement bar and multiplexer means that are arranged within said measurement bar, so as to trigger said sequential activation of said mutually opposite pairs of transmitters and receivers.

10. A device according to claim 9, wherein said multiplexer means is interposed between said logic control and storage means and one or more amplifier and filter means adapted to amplify and filter the light beams detected by said one or more receivers, said one or more amplifier and filter means being in turn connected to said one or more receivers.

11. A device according to claim 1, wherein there are provided power supply means connected to said logic control and storage means.

12. A device according to claim 11, wherein said power supply means comprise a power supply or accumulators.

* * * * *